US007215226B2

(12) United States Patent
Lee

(10) Patent No.: US 7,215,226 B2
(45) Date of Patent: May 8, 2007

(54) SKEW-SYMMETRICAL DEFECTED GROUND STRUCTURE FOR PARALLEL-COUPLED LINE FILTERS

(75) Inventor: Sheng-Yuan Lee, Taipei (TW)

(73) Assignee: VIA Technologies, Inc., Hsin-Tien, Taipei (TW)

( * ) Notice: Subject to any disclaimer, the term of this patent is extended or adjusted under 35 U.S.C. 154(b) by 192 days.

(21) Appl. No.: 11/050,385

(22) Filed: Feb. 1, 2005

(65) Prior Publication Data

US 2005/0258919 A1 Nov. 24, 2005

Related U.S. Application Data

(60) Provisional application No. 60/572,203, filed on May 18, 2004.

(51) Int. Cl.
*H01P 1/203* (2006.01)

(52) U.S. Cl. ..... 333/204; 333/246; 333/219

(58) Field of Classification Search ..... 333/204, 333/205, 246, 219
See application file for complete search history.

(56) References Cited

OTHER PUBLICATIONS

Park, Jun-Seok, "A Design of the Novel Coupled-Line Bandpass Filter Using Defected Ground Structure With Wide Stopband Performance", IEEE Transactions on Microwave Theory and Techniques, vol. 50, No. 9, (Sep. 2002), pp. 2037-2043.

*Primary Examiner*—Stephen E. Jones
(74) *Attorney, Agent, or Firm*—Kirkpatrick & Lockhart Preston Gates Ellis LLP

(57) ABSTRACT

A system and method are disclosed for improving the reliability of parallel-coupled line filters. In one embodiment, a parallel-coupled line filter system is disclosed which comprises at least one open-line resonator, at least one defected ground structure arranged on opposite sides of the line resonator having a first lattice and a second lattice in a skew-symmetrical fashion and coupled through a slim gap, wherein the first and second lattices are formed on a ground plane.

20 Claims, 6 Drawing Sheets

SKEW-SYMMETRICAL DEFECTED GROUND STRUCTURE FOR PARALLEL-COUPLED LINE FILTERS

CROSS REFERENCE

The present application claims the benefits of U.S. Provisional Application Ser. No. 60/572,203, which was filed on May 18, 2004 and entitled "Performance Of An Open-Line Resonator With A Defected Ground Structure And Its Application".

BACKGROUND

The present invention relates generally to radio frequency (RF) circuit designs, and more particularly to designs implementing skew-symmetrical defected ground structure (DGS) for parallel-coupled line filters.

A parallel-coupled line filter is one of the most commonly used microwave filter designs today because of its simple structure and easy fabrication process, since it does not require via connection to a ground plane. It is essentially a band-pass transmission-line filter composed of a series of half-wavelength resonant conductors in strips that are parallel-coupled, partially electric and partially magnetic, and span the distance of a quarter of one wavelength. This filter can be shorter in length when compared with other types of filters, such as an end-coupled filter.

However, conventional parallel-coupled line filter designs still have several disadvantages. While a conventional parallel-coupled line filter has a length that is shorter than some other types of filters, it still requires too much space in a circuit for today's technology because of its long strips of resonant conductors, which render the process inefficient and costly. Another serious disadvantage of a conventional parallel-coupled line filter is the out-of-band response. This conventional filter has a spurious response exactly twice its center frequency. Since many circuits will generate unwanted harmonics around this doubled frequency band, these unwanted harmonics will be passed through and interfere with the rest of the circuitry.

While a conventional symmetrical DGS can reduce circuit size and shift the spurious response, it may not be applicable to a parallel-coupled line filter since a conventional symmetrical DGS could overlap with adjacent resonators and cause the operation of the line filters to fail.

Desirable in the art of line filter designs are additional designs that improve the reliability thereof.

SUMMARY

In view of the foregoing, this invention provides systems and methods that improve the reliability of parallel-coupled line filters.

In one embodiment, a parallel-coupled line filter system is disclosed which comprises at least one open-line resonator, at least one defected ground structure arranged on opposite sides of the line resonator having a first lattice and a second lattice in a skew-symmetrical fashion and coupled through a slim gap, wherein the first and second lattices are formed on a ground plane. By managing the physical features of the skew-symmetrical lattices, at least a spurious response of the parallel-coupled line filter is shifted to a higher frequency band, thereby reducing interference and improving reliability.

The construction and method of operation of the invention, however, together with additional objects and advantages thereof will be best understood from the following description of specific embodiments when read in connection with the accompanying drawings.

DESCRIPTION

The present invention provides systems and methods that improve the reliability of parallel-coupled line filters.

Figure 1:
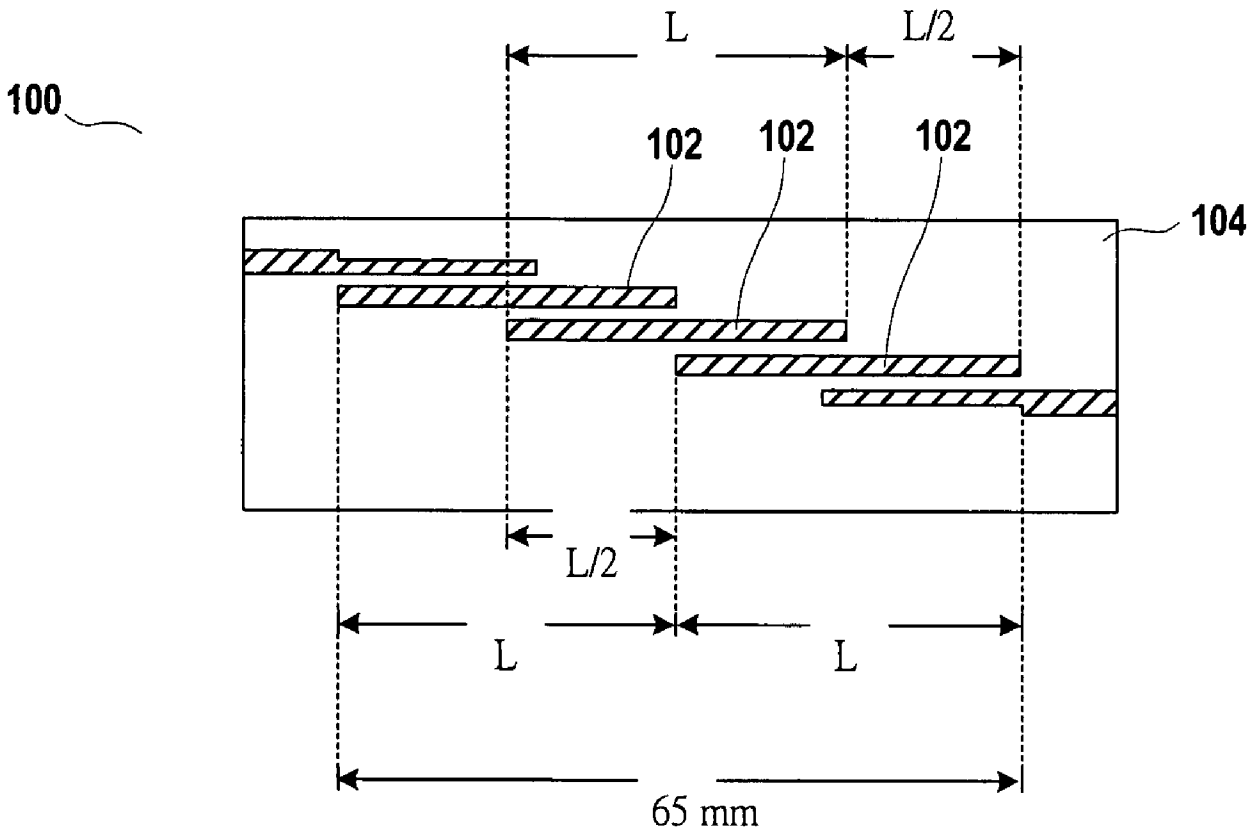
FIG. 1 (PRIOR ART)
FIG. 1 illustrates the top view of a conventional parallel-coupled line filter.

FIG. 1 illustrates the top view of a conventional parallel-coupled line filter 100. For example, the conventional parallel-coupled line filter 100 can exhibit a three-order filter response at 2.5 GHz. The conventional parallel-coupled line filter 100 are commonly used in relative applications due to their simple circuit structure and easy fabrication. The conventional parallel-coupled line filter 100 exhibiting a three-order filter response comprises of three open transmission line resonators 102 that are designed to have a length that is approximately half of the wavelength at the center frequency of the conventional parallel-coupled line filter 100. These open line resonators 102 are also commonly identified by those skilled in the art as open-line sections. The fabrication of the conventional parallel-coupled line filter 100 is relatively easy since no via connections to a ground plane 104 are necessary.

However, the physical size of the conventional parallel-coupled line filter 100 can be rather large due to the length of the open transmission line resonators 102. For example, the parallel-coupled line filter 100 has an end-to-end width of 65 mm. The large physical size of the conventional parallel-coupled line filter 100 is a major disadvantage since it can be inefficient and costly. Another disadvantage of the conventional parallel-coupled line filter 100 is the frequency of its out-of-band response. The conventional parallel-coupled line filter 100 has a spurious out-of-band response at approximately 5 GHz, which is exactly twice its center frequency of 2.5 GHz. Since many other circuits can generate unwanted harmonics at that doubled frequency, the conventional parallel-coupled line filter 100 can cause these unwanted harmonics to pass through and cause unwanted interferences.

Figure 2A:
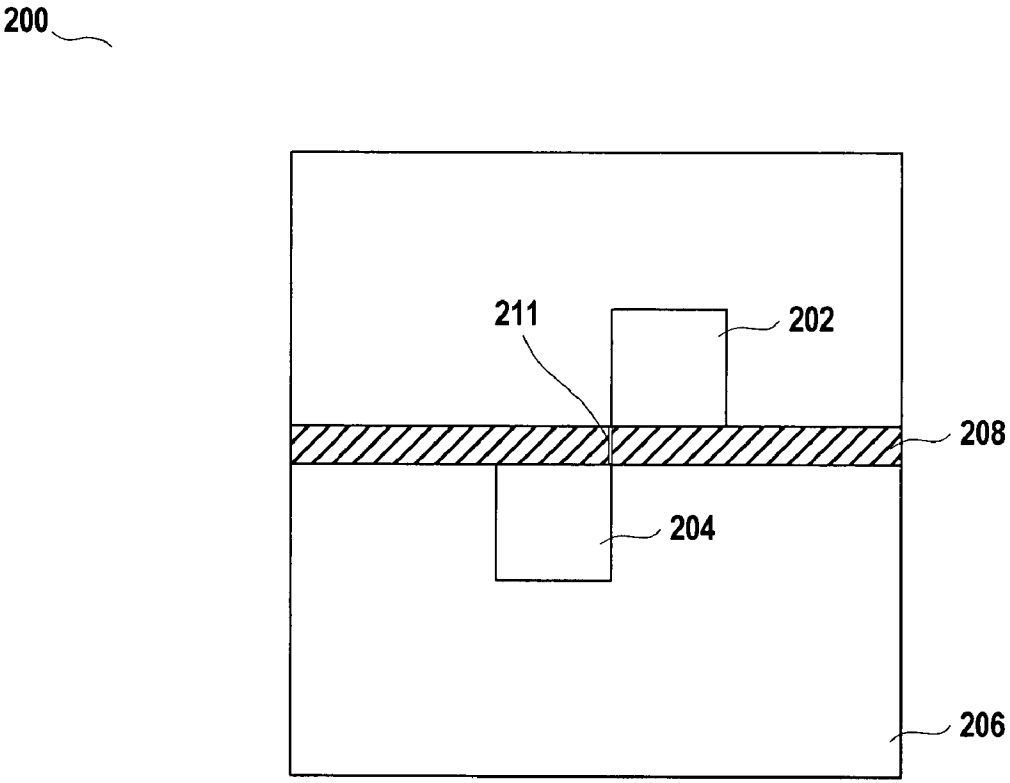
FIG. 2A illustrates an open-line resonator with a skew-symmetrical defected ground structure (DGS) in accordance with one embodiment of the present invention.

FIG. 2A illustrates an open-line resonator with a skew-symmetrical defected ground structure (DGS) 200 in accordance with one embodiment of the present invention. The skew-symmetrical DGS includes lattices 202 and 204 placed on a ground plane 206 in a skew-symmetrical fashion along an open transmission line resonator 208. The lattices 202 and 204 are etched on the ground plane 206 with the open-line section or open transmission line resonator 208 running across a slim gap 211 between the lattices 202 and 204. The term "skew-symmetrical" indicates that these two lattice entities are arranged to be on different sides of a virtual center line between them (or in this case, it can be understood that they are on different sides of the center open transmission line resonator 208), and are laterally offset so that are symmetrical with respect to a virtual center point. The lattices 202 and 204 are actually "coupled" through the slim vertical gap 211. This slim gap 211 can be formed at the same time as the lattices during the etching process. The lattices 202 and 204, which can be seen as a lattice pair, effectively create a parallel RLC resonant circuit in series with the open transmission line resonator 208. It is further noted that although the lattices 202 and 204 are illustrated as of rectangular shapes in FIG. 2A, but they don't have to be limited to the rectangular shapes. Furthermore, the sizes of these lattices can also vary. In fact, the two lattices do not have to be of the exactly the same size and shape. The varied sizes and shapes may affect the inductance introduced by these lattices, but the lattices conceptually have similar impact on the resonance frequency as the size and shape can be configured. This parallel RLC resonance can be used to reduce the length of the open transmission line resonator 208 and shift the spurious response of an open transmission line resonator 208 to a higher frequency such that interference can be minimized. The inductance value and the capacitance value of the parallel RLC resonant circuit is directly related to the shape of the lattices 202 and 204, as well as the gap distance between the lattices 202 and 204 on the ground plane 206. It is further noted that when the sizes and the shapes of the lattices are different, they are still considered to be in the skew-symmetrical arrangement as it is the overall symmetrical configuration with regard to the virtual center point that matters the most.

It is understood by those skilled in the art that a symmetrical DGS that is not positioned in a skewed fashion may not be able to apply to a parallel-coupled line filter properly since it can overlap the adjacent resonators, thereby causing failure during the line filter's operation. The newly-proposed DGS, or the skew-symmetrical DGS, is not restricted by layout limitations and can be applied to parallel-coupled line filters.

Figure 2B:
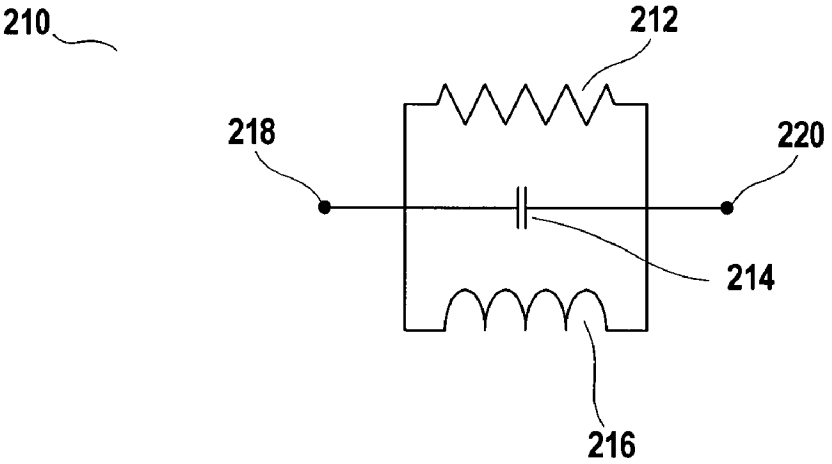
FIG. 2B illustrates an electrical circuit equivalent to the skew-symmetrical DGS.

FIG. 2B illustrates an electrical circuit 210 that is equivalent to the skew-symmetrical DGS. The electrical circuit 210 comprises a resistor 212, a capacitor 214, and an inductor 216 that are all tied together in parallel to provide an equivalent parallel RLC resonance. The resistance value of the resistor 212, the inductance value of the inductor 216 and the capacitance value of the capacitor 214 are directly related to the shape and size of the lattices as well as the gap distance between lattices. Since resonant mode frequencies are one of the most important characteristics for relative applications, it is essential to calculate their values, especially for the fundamental and the first spurious modes. It is understood that the fundamental mode represents the center resonant frequency. For the conventional parallel-coupled line filters, the first spurious mode represents a frequency that is twice the center resonant frequency. With calculated values for the resistor 212, the capacitor 214, and the inductor 216, the length of the open transmission line resonator can be reduced, while the first spurious response of the open transmission line resonator can also be shifted to a higher frequency to allow the open transmission line resonator to operate without harmonic interferences. Nodes 218 and 220 are shown to illustrate the connection points between the open transmission line sections and the RLC equivalent of the electrical circuit 210, which can be placed in series along the transmission line.

When a conventional open transmission line resonator is excited at its odd and even modes, it can be seen as operating in two respective modes: a fundamental mode and a first spurious mode. If it is excited at the odd mode, the center point of the resonator is essentially a "virtual short to ground". On the other hand, if it is excited at the even mode, the center point of the resonator will be "open". However, as will be understood by those skilled in the art, the resonance conditions of an open transmission line resonator can also be found from the even-mode and odd-mode excitation.

Figure 2C:
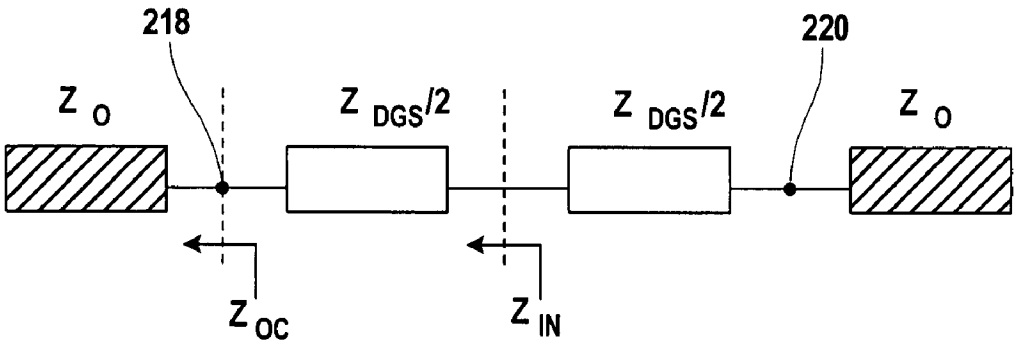
FIG. 2C illustrates an impedance equivalent of the skew-symmetrical DGS.

FIG. 2C is an equivalent circuit showing the equivalent impedance arrangement of the RLC equivalent of the electrical circuit 210. The total impedance of the parallel RLC resonance equivalent as shown in FIG. 2B can be referred to as $Z_{DGS}$. And the RLC resonant circuit is conceptually coupled to two open transmission line sections, each having an impedance of $Z_0$. The open transmission line sections represent the open transmission line resonator without the DGS. The resonant frequencies of an open transmission line resonator with DGS can be found by applying by either of the equations below:

$$Im[Z_{IN}]=Im[Z_{OC}+Z_{DGS}/2]=0 \quad (1)$$

$$Im[Z_{IN}]=Im[Z_{OC}+Z_{DGS}/2]\pm\infty \quad (2)$$

where $Z_{IN}$ is the input impedance looking from the mid point of the equivalent circuit, and the $Z_{OC}$ is the impedance looking from node 218 to the open side of FIG. 2B. It is understood that when $Im[Z_{DGS}]\neq\pm\infty$ and $Im[Z_{OC}]=\pm\infty$, formula (2) can be reduced as:

$$\theta=n\pi,\ n=1, 2, 3 \ldots, \quad (3)$$

The formula (3) corresponds to the even-mode resonances of the open line transmission line.

In order to calculate the resonant frequencies with more accuracy, it has been found that the resistance of the parallel RLC resonance should be included, especially when the quality factor Q of the resonator is small. On the other hand, to reveal the resonant behavior with any physical meaning, the resistance is neglected (assuming $R_{DGS}=\infty$) and the following equation can be derived from formula (1), wherein $\omega_{0DGS}$ is the resonant frequency of the DGS:

$$\cot\theta=(\omega_{0DGS}*L_{DGS})/(2Z_0*((\omega_{0DGS}/\omega)-(\omega/\omega_{0DGS})) \quad (4)$$

wherein θ represents half of the electrical length of the open transmission line 208, and $Z_0$ represents the transmission line characteristic impedance, while $L_{DGS}$ represents the equivalent inductance. Assuming that the fundamental-mode frequency of the open transmission line resonator is $\omega_{0OC}$ where $\theta=\pi/2$, the characteristics of the resonance of the open transmission line resonator with DGS can be classified into three different conditions, to be detailed below.

First, in a condition where $\omega_{0DGS}$ is higher than $2*\omega_{0OC}$, the resonant frequency of the DGS is higher than those of the first two resonances: the fundamental response and the first spurious response. The DGS will contribute an inductance at a frequency range that is lower than $\omega_{0DGS}$. It is understood that the formula (1) and (4) represents conditions need to be fulfilled for a fundamental mode of the resonator. The relationship between the length of the resonator and the resonant frequency under this first condition is such that if the resonant frequency is fixed at a predetermined value, then the length of the resonator is shorter when $L_{DGS}$ is larger and $Z_0$ is smaller. In other words, the resonator of a same length can resonate at a lower frequency due to the addition of the DGS if conditions from both formula (1) and (4) are fulfilled.

For the first spurious mode wherein formula (2) or (3) is fulfilled, it is the first even mode resonance of the open transmission line resonator. Since the DGS causes the fundamental mode resonance frequency to be shifted to a lower one by the addition of the DGS inductance, the first spurious response no longer occurs at a frequency twice as much as the fundamental-mode resonance frequency. In fact, the first spurious response can be predicted at a higher frequency by formula (3) with n set to 1.

Second, in a condition where $\omega_{0OC}<\omega_{0DGS}<2*\omega_{0OC}$, the first even mode of the open transmission line section becomes the third resonant mode of the resonator. At the frequency range beyond the frequency of the parallel resonance of the DGS, the DGS exhibits capacitance and causes a series resonance, which is the first spurious response of the resonator, with the inductance of the open transmission line section at that frequency. Since the frequency of this mode is less than that of the first even mode of the open transmission line resonator, the DGS should be carefully designed where $L_{DGS}$ is as large as possible while the equivalent capacitance, $C_{DGS}$, should be as small as possible. This allows the fundamental mode to be shifted to a lower frequency, and the first spurious response to be moved to a higher frequency. If $C_{DGS}$ is not small enough, the first spurious response will occur at a lower frequency which is near or even less than twice the fundamental-mode frequency.

Third, in a condition where $\omega_{0DGS}$ is approximately equal to twice the value of $\omega_{0OC}$, the characteristic of the fundamental mode of the open transmission line resonator with DGS is similar to the last two conditions. However, the parallel resonance of the DGS occurs near the first even-mode resonance of the open transmission line resonator. Since they are both parallel resonances and close to each other, the resonant condition of the whole resonator is complicated. However, the first spurious response still occurs around them because the open transmission line section dominates the response.

Figure 3A:
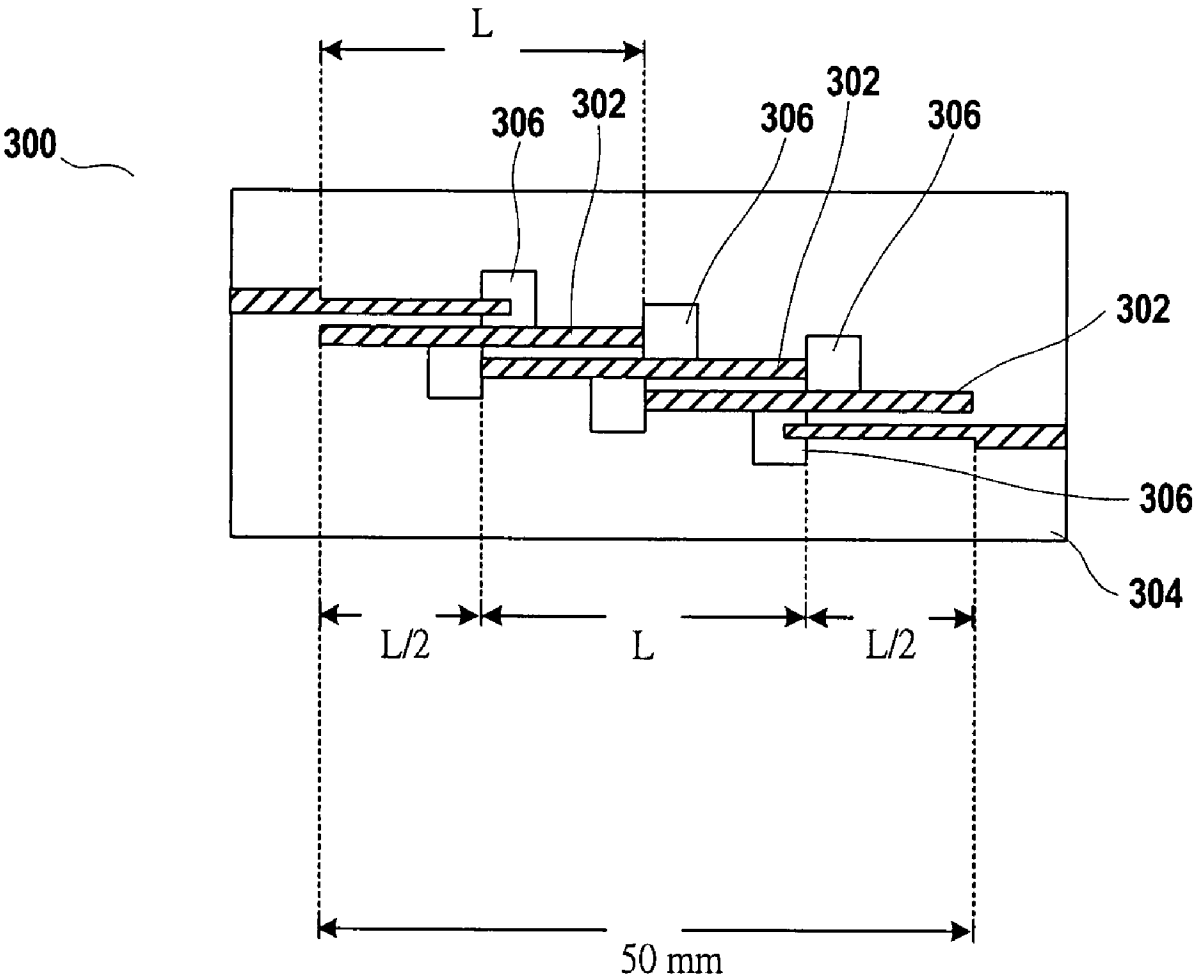
FIG. 3A illustrates the top view of a parallel-coupled line filter implemented with skew-symmetrical DGSs in accordance with one embodiment of the present invention.

FIG. 3A illustrates the top view of a parallel-coupled line filter 300 implemented with skew-symmetrical DGSs in accordance with one embodiment of the present invention. The parallel-coupled line filter 300 is composed of three open transmission line resonators 302 with the skew-symmetrical DGSs that are formed on a ground plate 304. While it is shown that there are three open transmission line resonators 302, it is understood that the invention does not limit to three-ordered response, and that line filters with different ordered responses can also be implemented without deviating from the spirit of this invention. Two rectangular lattices 306 are placed on the ground plane 304 in a skew-symmetrical fashion along each of the open transmission line resonators 302, thereby forming three skew-symmetrical DGSs.

The lattices 306 are etched on the ground plane 304 with the open transmission line resonators 302 running across the slim gap between each pair of the lattices 306. Each pair of the lattices 306 creates a parallel RLC resonant circuit in series with one of the open transmission line resonators 302. This parallel RLC resonance can be used to reduce the length of all of the open transmission line resonators 302 and shift the first spurious response of the parallel-coupled line filter 300 to a higher frequency such that interference by harmonics from other circuits can be minimized.

With the implementation of the skew-symmetrical lattices, the physical size of the parallel-coupled line filter 300 may be reduced as each of the open transmission line resonator is shorter. In this illustrated example, the total length of the parallel-coupled line filter 300 with skew-symmetrical DGS is only 50 mm, which compares favorably with the 65 mm achieved in the parallel-coupled line filter 100 that does not have any skew-symmetrical DGS. With skew-symmetrical DGS implemented, the parallel-coupled line filter 300 suffers lower conductance and dielectric loss, thereby allowing insertion loss to improve. The skew-symmetrical DGSs are not restricted by layout limitations, thereby allowing them to be implemented to other types of open transmission line resonators as well.

It is further noted that the total number of the open transmission line resonators may be either an odd or even number. As shown in this example, one open transmission line resonator can be placed in the middle with one above and one below it. The distance between the middle open transmission line resonator and the one above and below it can be equal. If an even number of resonators are used, they can still be arranged in a symmetrically manner along a virtual center point in the middle. Moreover, in order to make the filter compact, it is suggested that each open transmission line resonator overlaps with the one below it by approximately half of its length as the lattices for each resonator are arranged on both sides of the mid-point of the open transmission line. This arrangement does not interfere with the placement of the lattices while maximizing the space utilization. For the purpose of this invention, an arrangement like this, wherein the placement of the open transmission line resonators is somewhat symmetrical along at least a virtual center point of the filter, is deemed to be arranged in a symmetrical fashion. In the immediate example shown in FIG. 3A, the virtual center point would be along the slim gap between the lattices 306.

Figure 3B:
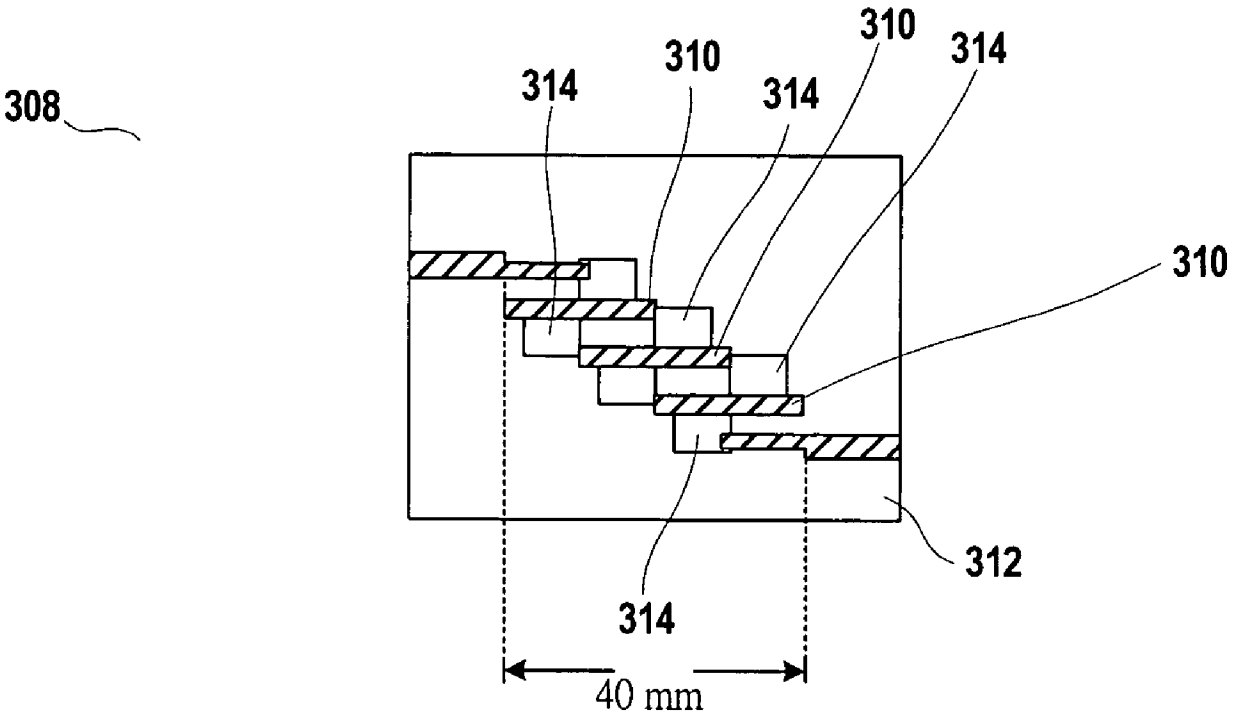
FIG. 3B illustrates the top view of another parallel-coupled line filter implemented with large skew-symmetrical DGSs in accordance with one embodiment of the present invention.

FIG. 3B illustrates the top view of another parallel-coupled line filter 308 implemented with large skew-symmetrical DGSs in accordance with one embodiment of the present invention. The parallel-coupled line filter 308 comprises three open transmission line resonators 310 with the skew-symmetrical DGSs which are placed on a ground plate 312. Three pairs of large rectangular lattices 314 are placed on the ground plane 312, each in a skew-symmetrical fashion and each along one of the open transmission line resonators 310, thereby forming three skew-symmetrical DGSs.

The large lattices 314 are etched on the ground plane 312 with the open transmission line resonators 310 running across the slim gap between each pair of the large lattices 314. Each pair of the large lattices 314 effectively creates a parallel RLC resonant circuit in series with one of the open transmission line resonators 310, with the values of the parallel RLC resonant circuit determined by the shape of the lattices as well as the gap between the lattices. This parallel RLC resonance can be used to reduce the length of the open transmission line resonators 310 and shift the spurious response of the parallel-coupled line filter 308 to a higher frequency such that interference by harmonics from other circuits can be minimized. Since the lattices 314 are larger than the lattices 306 from FIG. 3A, values of inductance and capacitance will be different, and, in this case, the total length of the parallel-coupled line filter 308 is reduced to 40 mm.

In this illustrated example, when larger lattices are implemented, the total length for the parallel-coupled line filter 308 is approximately 80 percent of the total length of the parallel-coupled line filter 300, and approximately 60 percent of the total length of the conventional parallel-coupled line filter 100. The insertion loss of the parallel-coupled line filter 308 will further be reduced since it suffers lower conductance and dielectric loss in comparison with the parallel-coupled line filters 100 and 300. The skew-symmetrical DGSs are not restricted by layout limitations, thereby allowing them to be implemented in other types of open transmission line resonators as well.

Figure 4:
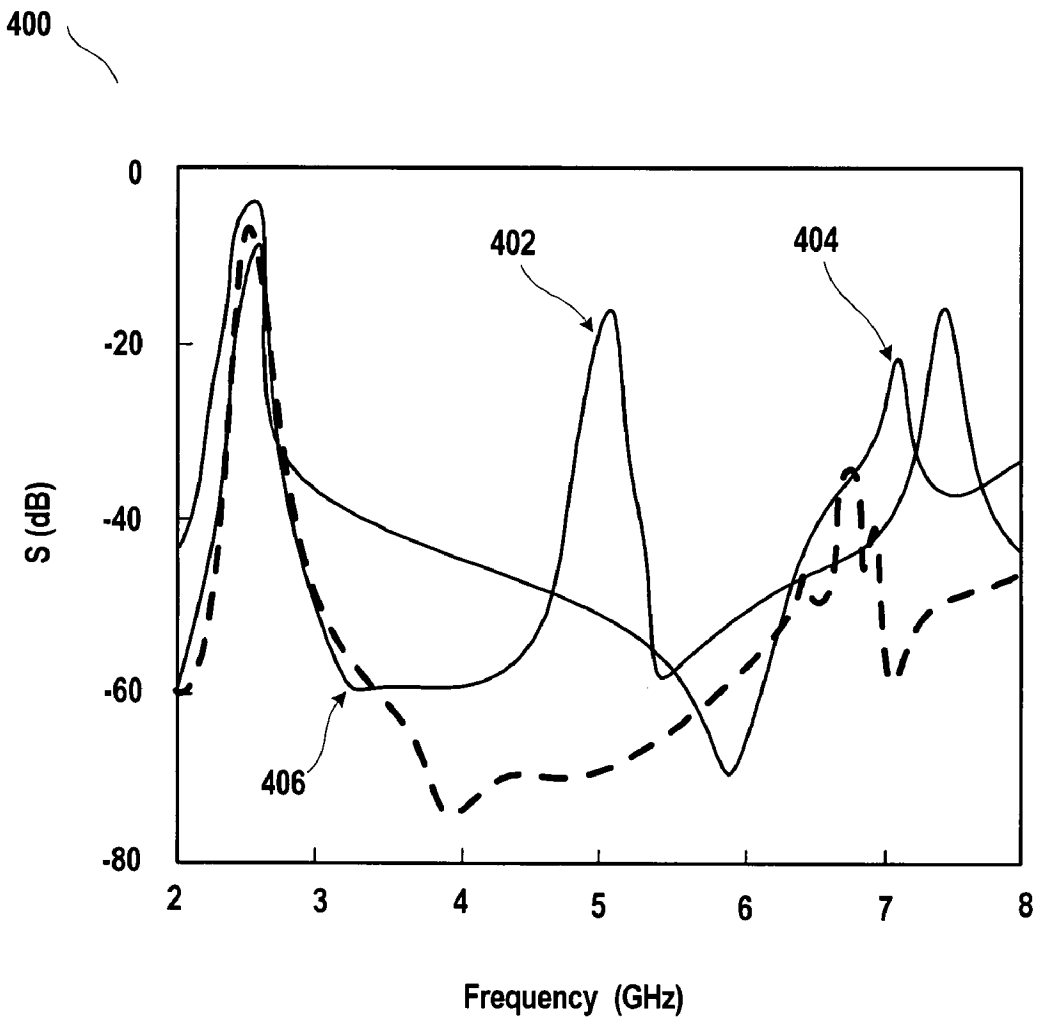
FIG. 4 presents a graph comparing the out-of-band response of the parallel-coupled line filters shown in FIG. 1, FIG. 3A, and FIG. 3B.

FIG. 4 presents a graph 400 comparing the out-of-band response of the parallel-coupled line filters shown in FIG. 1, FIG. 3A, and FIG. 3B. Response curves 402, 404, and 406 represent the out-of-band response of the parallel-coupled line filters 100, 300, and 308. The response curve 402 shows that the spurious response of the parallel-coupled line filter 100 is at around 5 GHz, which is twice its center frequency. Since many other circuits can generate unwanted harmonics around that doubled frequency, interferences can easily occur. The response curves 404 and 406 demonstrate that the first spurious response of both the parallel-coupled line filters 300 and 308 have been shifted to beyond at least 6 GHz, thereby allowing both the parallel-coupled line filters 300 and 308 to operate without harmonic interferences.

This invention provides systems and methods of implementing skew-symmetrical DGSs in parallel-coupled line filters to eliminate the disadvantages of the conventional filters containing those resonators. As illustrated above, with the properly arranged DGS, the open transmission line resonator can have its fundamental mode at a lower frequency, which is much more apart from its first spurious response than with a conventional resonator. Since the first spurious response is already shifted to a higher frequency, it is not necessary to design a DGS which resonates at exactly twice the frequency of the fundamental mode of the resonator. The present invention can be best applied to filters having a center frequency that is no lower than 1 GHz.

The above illustration provides many different embodiments or embodiments for implementing different features of the invention. Specific embodiments of components and processes are described to help clarify the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed is:

1. A parallel-coupled line filter system comprising:

at least one open transmission line resonator; and at least one defected ground structure arranged on opposite sides of the line resonator having a first lattice and a second lattice in a skew-symmetrical fashion, wherein the first and second lattices are formed on a ground plane and coupled through a gap therebetween.

2. The system of claim 1 wherein the first and second lattices are of a rectangular shape.

3. The system of claim 2 where in the first and second lattices are of a square shape.

4. The system of claim 1 wherein the first and second lattices are of a same shape and size.

5. The system of claim 1 wherein the skew-symmetrical defected ground structure exhibits an RLC resonance property of a parallel RLC resonant circuit coupled in series with the open transmission line resonator.

6. The system of claim 5 wherein a relation among an equivalent inductance of the RLC resonant circuit and a length of the open transmission line resonator is such that the larger the inductance, and the shorter the length.

7. The system of claim 1 wherein a shape of the lattices, a size of the lattices, and a gap distance between the lattices are configured for shifting a spurious response to unwanted harmonics to a higher frequency than that of a similarly arranged filter without the defected ground structure.

8. The system of claim 1 wherein an insertion loss is smaller than a similarly arranged filter without the defected ground structure.

9. The system of claim 1 wherein a center frequency of the filter is no lower than 1 GHz.

10. A parallel-coupled line filter system with a center frequency no lower than 1 GHz comprising:

one or more open transmission line resonators; and at least one defected ground structure for each resonator having a first lattice and a second lattice arranged on opposite sides of the line resonator in a skew-symmetrical fashion and coupled through a gap therebetween, wherein the first and second lattices are formed on a ground plane with a substantially rectangular shape.

11. The system of claim 10 wherein the first and second lattices are of a same size.

12. The system of claim 10 wherein the skew-symmetrical defected ground structure exhibits an RLC resonance property of a parallel RLC resonant circuit coupled in series with the open transmission line resonator.

13. The system of claim 12 wherein a relation among an equivalent inductance of the RLC resonant circuit and a length of the open transmission line resonator is such that the larger the inductance, the shorter the length.

14. The system of claim 10 wherein a shape of the lattices, a size of the lattices, and a gap distance between the lattices are configured for shifting a spurious response to unwanted harmonics to a higher frequency band than that of a similarly arranged filter without the defected ground structure.

15. The system of claim 10 wherein the lattices for a predetermined resonator do not overlap with their neighboring lattices.

16. A parallel-coupled line filter system with a center frequency no lower than 1 GHz, the system comprising:

one or more open transmission line resonators arranged in a symmetrical fashion; and at least one defected ground structure arranged on opposite sides of the line resonator having a first lattice and a second lattice in a skew-symmetrical fashion and coupled through a gap therebetween, wherein the first and second lattices are of a rectangular shape and formed on a ground plane, and wherein the lattices are configured to provide a fundamental mode of the filter to be at a lower frequency than a first spurious response frequency of the filter system.

17. The system of claim 16 wherein the first and second lattices are of a same shape and size.

18. The system of claim 16 wherein the skew-symmetrical defected ground structure functions as a parallel RLC resonant circuit coupled in series with the open transmission line resonator wherein a relation among an equivalent inductance of the RLC resonant circuit and a length of the open transmission line is such that the larger the inductance, the shorter the length.

19. The system of claim 16 wherein a shape of the lattices, a size of the lattices, and a gap distance between the lattices are configured for providing a spurious response to unwanted harmonics at a higher frequency than that of a similarly arranged filter without the defected ground structure.

20. The system of claim 16 wherein each open transmission line resonator overlaps about half of an open transmission line resonator below it.

* * * * *